US008669520B2

(12) United States Patent
Sutin

(10) Patent No.: US 8,669,520 B2
(45) Date of Patent: Mar. 11, 2014

(54) WAVEFORM GENERATION FOR ION TRAP

(75) Inventor: Brian M. Sutin, Claremont, CA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 0 days.

(21) Appl. No.: 13/559,037

(22) Filed: Jul. 26, 2012

(65) Prior Publication Data

US 2014/0027628 A1 Jan. 30, 2014

(51) Int. Cl.
*H01J 49/36* (2006.01)

(52) U.S. Cl.
USPC ..... 250/283; 250/286

(58) Field of Classification Search
USPC ..... 250/281–283, 286, 287
See application file for complete search history.

(56) References Cited

U.S. PATENT DOCUMENTS 5,386,113 A * 1/1995 Franzen et al. ..... 250/292
5,404,011 A * 4/1995 Wells et al. ..... 250/282
5,796,100 A 8/1998 Palermo
6,121,610 A * 9/2000 Yoshinari et al. ..... 250/292
6,965,106 B2 11/2005 Ding et al.
7,193,207 B1 3/2007 Ding et al.
7,285,773 B2 10/2007 Ding et al.
2003/0155502 A1* 8/2003 Grosshans et al. ..... 250/282
2005/0145790 A1* 7/2005 Wang ..... 250/292
2008/0035841 A1* 2/2008 Ding ..... 250/283
2008/0054173 A1* 3/2008 Yasuda et al. ..... 250/283
2010/0320377 A1* 12/2010 Cotter et al. ..... 250/283

OTHER PUBLICATIONS

R. E. March, "An Introduction to Quadrupole Ion Trap Mass Spectrometry", from Journal of Mass Spectrometry, vol. 32, pp. 351-369 (1997).

* cited by examiner

*Primary Examiner* — Robert Kim
*Assistant Examiner* — David E Smith
(74) *Attorney, Agent, or Firm* — Kinney & Lange, P.A.

(57) ABSTRACT

An ion trap comprises a ring electrode and opposite first and second endcap electrodes situated at opposite ends of the ring electrode. A waveform generator is configured to vary both frequency and amplitude of an AC waveform applied across the first and second endcap electrodes as a function of time, thereby exciting ions with a band of resonant secular frequencies substantially without exciting ions with adjacent secular frequencies.

10 Claims, 2 Drawing Sheets

WAVEFORM GENERATION FOR ION TRAP

BACKGROUND

The present invention relates generally to ion traps, and more particularly to a waveform generation method for a three dimensional quadrupole ion trap mass spectrometer simultaneously using both amplitude modulation and frequency modulation.

Three dimensional quadrupole ion traps typically consist of a hyperbolic ring electrode capped by two opposite hyperbolic electrode endcaps. The ring and the endcaps define an interior space wherein ions are trapped by oscillating electric fields generated between the ring and the endcaps. Most quadrupole ion traps apply radio frequency voltage to the endcaps and ring electrodes. By modulating the frequency of voltage applied to the endcaps, ions of a particular mass-to-charge ratio m/z can be excited and/or ejected from the trap.

Quadrupole ion trap mass spectrometers conventionally feature two active modes: an isolation mode and an excitation mode. In the isolation mode, ions of undesirable m/z are ejected from the ion trap by applying a large endcap voltage at a range of frequencies resonant with m/z outside of a selected range. In the excitation mode, remaining ions are excited with lower endcap voltages at a range of frequencies resonant with m/z in the selected range.

Both excitation and isolation modes utilize frequency bandpasses to selectively excite or eject particular ion masses. A variety of methods for creating bandpass waveforms are known in the art. Some conventional waveform generation methods for quadrupole ion traps use a comb of summed, equally-spaced fixed frequencies distributed across an excitation or isolation band. Other conventional methods use Fourier transforms or frequency modulation. Some prior art methods can produce nonuniform or imprecise bandpasses with large discontinuities in amplitude, scattering significant amounts of power outside the intended bandpass region.

SUMMARY

The present invention is directed toward an ion trap comprising a ring electrode and opposite first and second endcap electrodes situated at opposite ends of the ring electrode. A waveform generator is configured to vary both frequency and amplitude of an alternating current (AC) waveform applied across the first and second endcap electrodes as a function of time, thereby exciting ions with a band of resonant secular frequencies substantially without exciting ions with adjacent secular frequencies.

DETAILED DESCRIPTION

Figure 1:
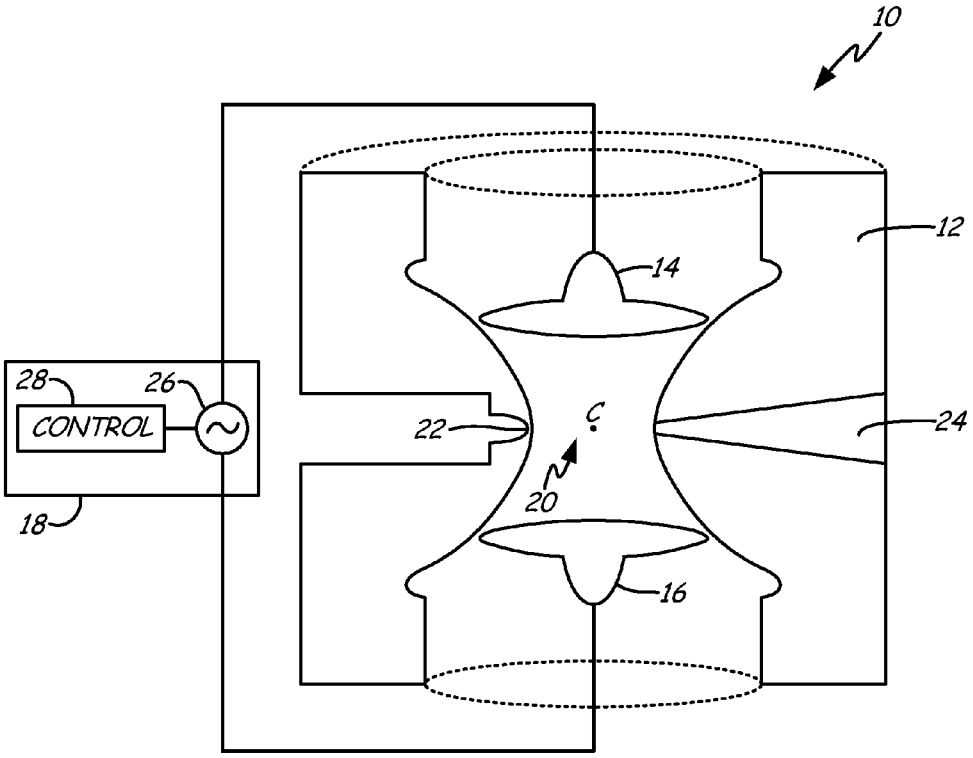
FIG. 1 is a schematic view of a quadrupole ion trap.

FIG. 1 illustrates quadrupole ion trap 10, comprising ring electrode 12, top endcap electrode 14, bottom endcap electrode 16, and waveform generator 18. Top endcap electrode 14, bottom endcap electrode 16, and ring electrode 12 surround containment region 20. Ring electrode 12 includes ion gate 22 and expulsion passage 24, and waveform generator 18 includes AC power source 26 and controller 28.

Ring electrode 12 is an annular electrode of substantially hyperbolic cross-section, with foci facing inwards towards containment region 20. Top endcap electrode 14 and bottom endcap electrode 16 are substantially symmetric hyperbolic electrodes situated at opposite ends of the interior of ring electrode 12. Ring electrode 12 and top and bottom endcap electrodes 14 and 16 are formed of conductive materials. Foci of ring electrode 12, top endcap electrode 14, and bottom endcap electrode 16 are aligned with a common centerpoint C of containment region 20. Quadrupole ion trap 10 retains charged particles at and around common centerpoint C.

Ion gate 22 is an electrostatic gate that pulses open and closed to inject ions into containment region 20. The time during which ions are allowed into containment region 20 (the "ionization period") is selected to minimize space-charge distortion effects resulting from an excessive number of ions in containment region 20. Ions in containment region 20 are focused toward centerpoint C by application of an oscillating voltage $V_{ring}$ to ring electrode 12. $V_{ring}$ may be a combination of AC and DC voltage. The stability of trapping of an ion depends on the frequency of $V_{ring}$, the dimensions of ion trap 10, and the mass and charge of each ion, as is well known in the art. This stability is characterized by the dimensionless parameter $q_z$, where $$q_z = \frac{4\ \text{eV}}{mr^2w^2} \qquad \text{[Equation 1]}$$

where V and w are the amplitude and frequency of oscillation of respectively, r is the radius of quadrupole ion trap 10, and m is the mass of a particular ion. Ions oscillate within containment region 10 at a secular frequency $f_{sec}$ dependent on $q_z$ and on w. Containment region 20 may be filled with a dampening gas such as helium to further contract ion trajectories towards centerpoint C.

Waveform generator 18 supplies supplemental AC voltage $V_{sup}$ across top endcap electrode 14 and bottom endcap electrode 16. In some embodiments of the present invention, waveform generator 18 may control voltage across the top and bottom endcap electrodes 14 and 16. In other embodiments, waveform generator 18 may apply voltage to only one of these electrodes, with the other being grounded. Waveform generator 18 includes both AC power source 26, a voltage source capable of producing AC voltage with configurable frequency, and a controller 28, a logic-capable component configured to sweep bandpass frequency regions as described in greater detail below. $V_{sup}$ produces resonance for exciting and ejecting ions from containment region 20. In general, resonance conditions occur where $f_{seq}$ matches frequency $f_{sup}$ of $V_{sup}$. When resonance occurs, low amplitudes of $V_{s\ up}$ excite ions at resonance, while high amplitudes of $V_{sup}$ eject resonant ions from containment region 20, sending them toward endcap electrodes 14 and 16 and/or ring electrode 12. For mass spectrometry readouts, ions are expelled from containment region 20 via expulsion passage 24, a channel extending from containment region 20 to readout equipment external to quadrupole ion trap 10.

Waveform generator 18 is used to select particular resonant frequency bands for excitation and/or ejection. Quadrupole ion trap 10 may, for example, be sequentially operated in an isolation mode wherein waveform generator 18 produces high amplitude AC voltages across a band of resonant frequencies $f_{sup}$ corresponding to undesired m/z ions, which are consequently ejected from the ion trap. Waveform generator 18 may also be used to excite selected masses with lower amplitude AC voltages across a band of resonant frequencies, breaking up those ions into smaller components. Waveform generator 18 may also provide other waveforms for other purposes, including for readout to a mass spectrometer. Quadrupole ion trap 10 may function as a part of a mass spectrometer, for instance, by sequentially breaking and ejecting fragment ions with increasing m/z by choosing amplitudes of $V_{sup}$ that sequentially resonate with ions of each m/z.

For both ejection and excitation of selected ions in containment region 20, waveform generator 18 applies voltages $V_{sup}$ to top endcap electrode 14 and bottom endcap electrode 16 across particular frequency bands without exciting ions resonant at adjacent frequencies. Accordingly, the waveform generated by waveform generator 18 has a substantially constant amplitude at selected resonant frequencies, and little to no amplitude at other frequencies. A waveform generation system to accomplish this task is detailed below.

To excite and eject ions, waveform generator 18 applies AC supplemental voltage $V_{sup}$ to top and bottom endcap electrodes 14 and 16. Both the amplitude and frequency of supplemental voltage $V_{sup}$ vary over time to substantially uniformly sample a band of resonant frequencies. $V_{sup}$ has frequency $f_{sup}$ and amplitude $A_{sup}$ defined as:

$$f_{sup}(t)=F_c+\Delta F\cos(2\pi F_m t);\text{ and} \qquad \text{[Equation 2]}$$

$$A_{sup}(t)=|2\pi T\Delta F\sin(2\pi F_m t)|^{1/2} \qquad \text{[Equation 3]}$$

where T is waveform duration, $F_c$ is the center frequency of the sampling band, ΔF is the half-bandwidth of the sampling band, t is time, and $F_m$=T/2S where S is the total number of times an identical waveform is sent.

Waveform generator 18 produces supplemental voltage $V_{sup}$ from a single continuous function using simultaneous amplitude and frequency modulation. Waveform generator 18 thus avoids large voltage swings on top and bottom endcap electrodes 14 and 16. Accordingly, the waveform of supplemental voltage $V_{sup}$ is substantially uniform across specified resonance frequencies (e.g. for ejection or excitation), and substantially zero at adjacent frequencies. This sharp delineation allows quadrupole ion trap 10 to be used for higher resolution mass spectroscopy than conventional ion traps.

Figure 2:
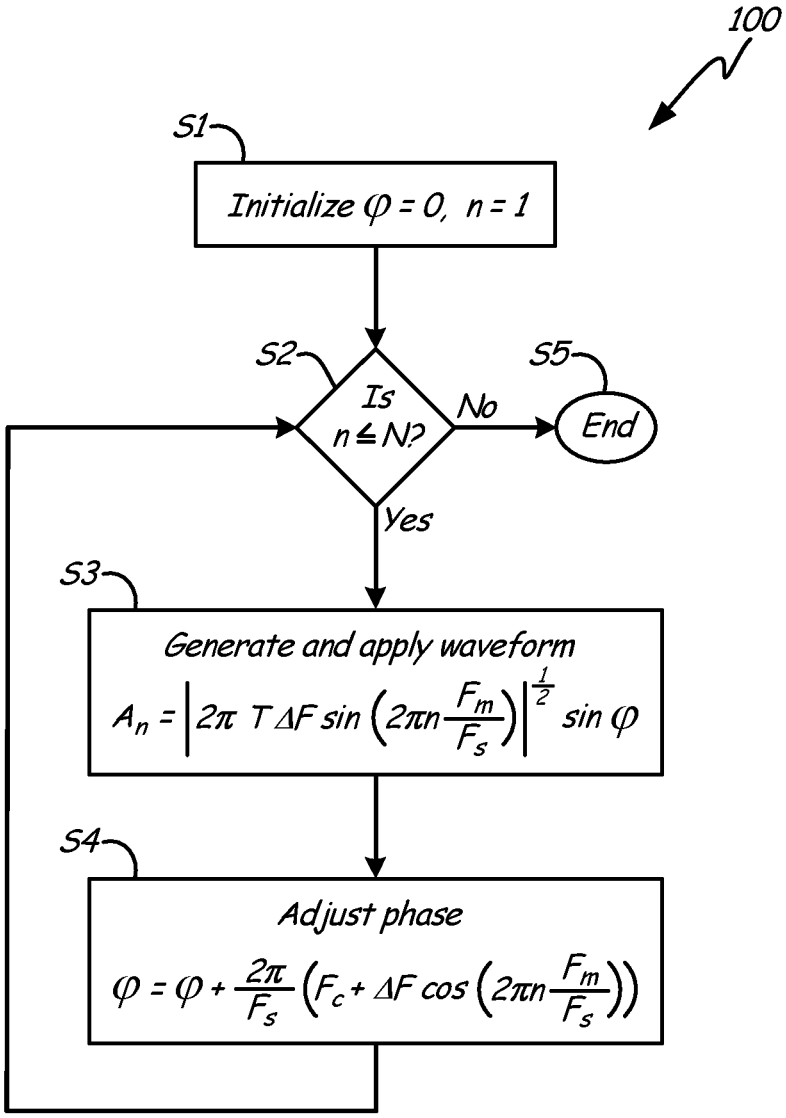
FIG. 2 is a flow chart of a waveform generation method for the quadrupole ion trap of FIG. 1.

FIG. 2 is a flow chart of method 100. Method 100 is one possible algorithm utilized by waveform generator 18 to generate supplemental voltage $V_{sup}$. First, starting values of phase ϕ and iteration number n are selected and initialized, e.g. ϕ=0 and n=1 (step S1). Iteration number n is a counter representing the ordinal of each iteration, up to N total iterations corresponding to N waveform sample points. N=T*$F_s$, where T is the total time duration of the waveform, and $F_s$ is the sampling frequency, as described above with respect to FIG. 1. C is a predetermined voltage amplitude constant. For n<=N (step S2), waveform generator 18 generates a voltage amplitude $A_n$ (step S3):

$$A_n = C\left|2\pi T\Delta F\sin\left(2\pi n\frac{F_m}{F_s}\right)\right|^{1/2}\sin(\varphi) \qquad \text{[Equation 4]}$$

and applies this voltage to top and bottom endcap electrodes 14 and 16. Next, waveform generator 18 adjusts phase ϕ for the next pass (step S4):

$$\varphi = \varphi + \frac{2\pi}{F_s}\left(F_c + \Delta F\cos\left(2\pi n\frac{F_m}{F_s}\right)\right) \qquad \text{[Equation 5]}$$

This process repeats for each successive phase ϕ and iteration number n until n>N and the entire phase space is traversed. In pseudo-code, method 100 may be implemented as follows:

| | |
|---|---|
| $\phi = 0$ | # phase of endcap waveform |
| for n = 1:N | # step through sample points |
| $\theta = 2\pi n F_m/F_s$ | # phase of modulation |
| $OUT[n] = C\ |2\pi T\Delta F\sin(\theta)|^{1/2}\sin(\phi)$ | # output amplitude of nth point |
| $\phi = \phi + 2\pi(F_c + \Delta F\cos(\theta))/F_s$ | # adjust phase for next point |

Method 100 illustrates one possible method for generating and applying the $V_{sup}$ waveform described by equations 2 and 3. This waveform substantially uniformly excites specified resonance frequencies while providing little excitation at adjacent frequencies, as described above. Method 100 is sufficiently simple to be embedded in any field-programmable gate array (FPGA) or other programmable logic chip. Method 100 allows for improved efficiency and reduced interference in mass spectroscopy applications by improving the ejection of unwanted ions and reducing the loss of desired ions during isolation.

While the invention has been described with reference to an exemplary embodiment(s), it will be understood by those skilled in the art that various changes may be made and equivalents may be substituted for elements thereof without departing from the scope of the invention. In particular, although the present disclosure focuses on the generation of waveforms for quadrupole ion traps, similar or identical waveforms may be used with other ion trap geometries, such as octopole or linear ion traps, or traps with non-hyperbolic electrodes. In addition, many modifications may be made to adapt a particular situation or material to the teachings of the invention without departing from the essential scope thereof. Both isolation and excitation waveforms may have more than one pass band, and these passbands can be sent simultaneously or in series. Therefore, it is intended that the invention not be limited to the particular embodiment(s) disclosed, but that the invention will include all embodiments falling within the scope of the appended claims.

The invention claimed is:

1. An ion trap comprising:

a ring electrode;

first and second endcap electrodes situated on opposite ends of the ring electrode; and a waveform generator configured to simultaneously vary both frequency and amplitude of an AC voltage waveform applied across the first and second endcap electrodes as a function of time, thereby exciting ions with a band of resonant secular frequencies substantially without exciting ions with adjacent secular frequencies, wherein the AC voltage waveform has a frequency as a function of time t defined as $f_{sup}(t)=F_c+\Delta F\cos(2\pi F_m t)$, and an amplitude as a function of time t defined as $A_{sup}(t)=|2\pi T\Delta F\sin(2\pi F_m t)|^{1/2}$, where T is waveform duration, $F_c$ is the center frequency of a sampling band with half-bandwidth ΔF, and $F_m$ is a waveform modulation frequency.

2. The ion trap of claim 1, wherein the waveform generator comprises an adjustable AC power source and a logic-capable controller.

3. The ion trap of claim 1, wherein the ring electrode and the opposite first and second endcap electrodes have substantially hyperbolic cross-sections with foci aligned with a common centerpoint.

4. The ion trap of claim 1, wherein the ring electrode and the opposite first and second endcap electrodes together define a containment region.

5. The ion trap of claim 4, further comprising an electrostatic ion gate situated in the ring electrode and configured to inject ions into the containment region.

6. The ion trap of claim 4, wherein the waveform generator is capable of sweeping the band of resonant frequencies at high amplitude to eject ions of a specified mass-to-charge ratio from a containment region located radially inward of the ring electrode and between the first and second endcap electrodes.

7. The ion trap of claim 4, wherein the waveform generator is capable of sweeping the band of resonant frequencies at low amplitude to excite ions at specified mass-to-charge ratio.

8. A method of operating an ion trap, the method comprising:

applying a first oscillating voltage to a ring electrode to confine ions in a confinement region;

applying a second oscillating voltage across first and second endcap electrodes situated at opposite ends of the ring electrode; and simultaneously varying both amplitude and frequency of a waveform of the second oscillating voltage so as to substantially uniformly excite ions with secular frequencies in a selected a frequency band, without exciting ions of adjacent secular frequencies, wherein the waveform of the second oscillating voltage has a duration T, half-width $\Delta F$, center frequency $F_c$, modulation frequency $F_m$, a frequency as a function of time t defined as $f_{sup}(t)=F_c+\Delta F\cos(2\pi F_m t)$, and an amplitude as a function of time t defined as $A_{sup}(t)=|2\pi T\Delta F\sin(2\pi F_m t)|^{1/2}$.

9. The method of claim 8, wherein the second oscillating voltage breaks and ejects fragments of ions with selected mass-to-charge ratios.

10. The method of claim 8, wherein the ring electrode and the first and second endcap electrodes form substantially symmetric hyperbolic walls of a quadrupole ion trap.

* * * * *